United States Patent [19]

Nolting et al.

[11] Patent Number: 5,036,803

[45] Date of Patent: Aug. 6, 1991

[54] DEVICE AND METHOD FOR ENGINE COOLING

[75] Inventors: Peter Nolting, Bühlertal; Wolfgang Scheidel, Bühl, both of Fed. Rep. of Germany

[73] Assignee: Robert Bosch GmbH, Stuttgart, Fed. Rep. of Germany

[21] Appl. No.: 466,285

[22] PCT Filed: Oct. 26, 1988

[86] PCT No.: PCT/DE88/00667

§ 371 Date: Mar. 26, 1990

§ 102(e) Date: Mar. 26, 1990

[87] PCT Pub. No.: WO89/04419

PCT Pub. Date: May 18, 1989

[30] Foreign Application Priority Data

Nov. 12, 1987 [DE] Fed. Rep. of Germany ..... 3738412

[51] Int. Cl.[5] ..... F01P 7/14

[52] U.S. Cl. ..... 123/41.1; 123/41.05; 123/41.15; 123/41.44

[58] Field of Search ..... 123/41.01, 41.02, 41.04, 123/41.05, 41.1, 41.15, 41.44, 44.47, 440; 237/12.3 B

[56] References Cited

U.S. PATENT DOCUMENTS

| | | | |
|---|---|---|---|
| 2,703,680 | 3/1955 | Nallinger | 237/12.3 B |
| 3,854,459 | 12/1974 | Stimeling | 123/41.04 |
| 3,999,598 | 12/1976 | Fehr et al. | 123/41.02 |
| 4,167,924 | 9/1979 | Carlson et al. | 123/440 |
| 4,591,691 | 5/1986 | Badali | 123/142.5 E |
| 4,656,973 | 4/1987 | Endres | 123/41.15 |
| 4,691,669 | 9/1987 | Otteman et al. | 123/41.15 |
| 4,726,325 | 3/1988 | Itakura | 123/41.1 |
| 4,759,316 | 7/1988 | Itakura | 123/41.44 |

FOREIGN PATENT DOCUMENTS

| | | |
|---|---|---|
| 1233656 | 2/1967 | Fed. Rep. of Germany . |
| 3024209 | 1/1981 | Fed. Rep. of Germany . |
| 3424580 | 11/1985 | Fed. Rep. of Germany . |
| 3435833 | 4/1986 | Fed. Rep. of Germany . |
| 2631121 | 1/1987 | Fed. Rep. of Germany . |
| 1392259 | 2/1965 | France . |
| 2519694 | 7/1983 | France . |

OTHER PUBLICATIONS

European Pat. Appl. 0084378, Jul. 27, 1983.
European Pat. Appl. 0038556, Oct. 28, 1981.

*Primary Examiner*—Noah P. Kamen
*Attorney, Agent, or Firm*—Michael J. Striker

[57] ABSTRACT

A device for engine cooling includes at least one mechanical coolant pump driven by the engine to be cooled and at least one electric coolant pump controlled by an electronic switching device being provided in at least one cooling circuit of an engine to be cooled. The conveying capacity of the electric pump is set as a function of operating variables of the engine to be cooled and of further variables, while the mechanical pump is designed for a basic conveying capacity. In the coolant circuit a heat exchanger which is operated as a radiator, the cooling capacity of which can be altered with the aid of a radiator blind and of a fan, is arranged in a first coolant path. An additional heat exchanger, the waste heat of which is used for heating purposes or for further engine cooling, is arranged in an additional coolant path or in a separate coolant circuit.

13 Claims, 2 Drawing Sheets

DEVICE AND METHOD FOR ENGINE COOLING

BACKGROUND OF THE INVENTION

The invention is related to a device and a method for engine cooling of the general type of the main claim. A vehicle engine cooling system developed for a test vehicle is known from automnobiltechnische Zeitschrift 87 (1985), volume 12, pp. 638–639. An electrically driven water pump is provided, with the aid of which the cooling water throughflow is matched to the requirement, e.g. the increased requirements at higher speeds or upon switching off the engine after higher speeds.

SUMMARY OF THE INVENTION

It is an object of the present invention to provide a device and method for engine cooling which provides increased operational reliability beyond the devices of the prior art as well as an increased economy.

This object and others which will be made more apparent hereinafter is attained in a device for engine cooling which has a coolant circuit containing a heat exchanger, which can act as a radiator, a bypass for the radiator and an electric coolant pump whose pumping capacity can be altered.

According to the present invention the device for engine cooling is described in claim 1 and also has a mechanical coolant pump driven by the engine whose conveying capacity is set to a predetermined part of the required cooling capacity and an electronic switching device connected to at least one coolant temperature sensor, which controls the electric pump depending on coolant temperature. Advantageously other engine operating variable may also be used to control the electric pump.

In contrast, the device according to the invention for engine cooling has the advantage that a mechanical coolant pump driven by the engine to be cooled and an electrically driven coolant pump is provided, the conveying capacity of which is controlled as a function of measured values. The mechanical pump takes on a base load while the conveying capacity of the electric pump can be matched to the required cooling capacity. In addition to an economical mode of operation of the engine, the operating temperature of which can be held in an optimum range by means of the coolant, the device according to the invention increases the operational reliability of the engine cooling system. If a pump fails, a restricted engine operation or at least an emergency operation is guaranteed.

Advantageous further developments and improvements of the device given in the main claim are possible by virtue of the measures listed in the subclaims.

In addition to the coolant temperature, the electronic switching device controlling the electric pump and the other components, blind, fans and mixing valves, receives further information such as, for example, the engine operating temperature, the engine compartment temperature, temperatures of engine parts, ambient temperature, engine speed, travelling speed and a pressure signal of the coolant. With this information, a precise matching of the conveying capacity of the electric pump to the required cooling capacity is possible.

In an advantageous embodiment of the device according to the invention, a second coolant circuit having a heat exchanger is provided. If the engine to be cooled is arranged as driving motor in a motor vehicle, the waste heat of the exchanger is used for heating the vehicle interior. According to the invention, it is provided that this circuit is likewise controlled by the electronic switching device, the heating circuit also contributing in known manner to the cooling of the engine in summer by the shutting off of the heating ducts leading into the interior and the simultaneous opening of air ducts leading to the open air. The circuit deals, for example, with cooling capacity peaks.

In a further embodiment of the device according to the invention, the second coolant circuit is designed as an independent cooling circuit having its own coolant pump. Using this embodiment, a further improvement of the control of cooling capacity is made possible.

The method according to the invention for operating the device has the advantage that the conveying capacity of the electric pump is effected not only as a function of the coolant temperature but as a function of at least one further operating variable.

In the case of the use of the second cooling circuit for engine cooling in the summer, an advantageous further development of the method according to the invention is the actuation of an air flap by the electronic switching device, the air flap blocking the heating air duct and freeing an air duct leading to the open air.

The possibility of maintaining an emergency operation of the engine if one of the coolant pumps fails is particularly advantageous. After the actuation of a corresponding warning signal or action taken on the engine control system, engine operation at reduced power is possible.

Further details and advantageous further developments of the device according to the invention and of the method according to the invention emerge from further subclaims in conjunction with the description which follows.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
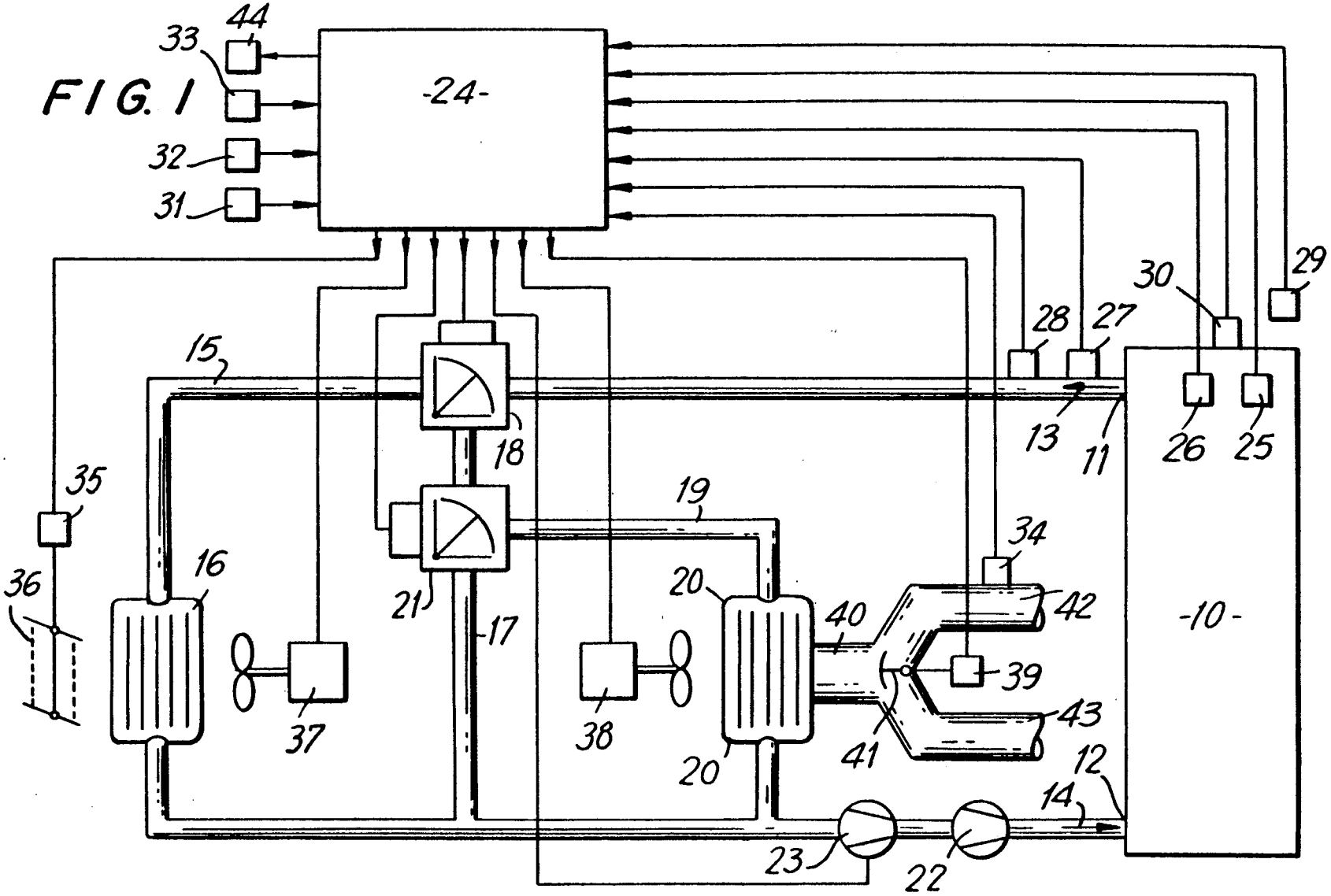
FIGS. 1 and 2 show a first and a second exemplary embodiment of a device according to the invention for engine cooling.

FIG. 1 shows an engine 10 to be cooled having a first and a second coolant circuit connection 11, 12. The coolant leaves the engine 10 at the first connection 11 and returns to the engine 10 at the second connection 12. The direction of flow of the coolant is indicated by arrows, 13, 14. The coolant circuit contains a first coolant path 15, in the course of which is arranged a first heat exchanger 16 which can be operated as a radiator. The first coolant path 15 can be bridged with a second coolant path 17 connected as a bypass. The distribution of coolant to the first and second path 15, 17 is controlled by a first controllable valve 18. The valve 18 can be a valve controlled by the coolant temperature. Preferably, it is designed as an electrically controllable valve. The valve 18 operates either continuously or in cyclical operation. In cyclical operation, the coolant flow to the first or second coolant path 15, 17 is either completely opened or completely blocked. The cyclical operation is suitable, in particular, in the case of an electrically controlled valve 18.

A third coolant path 19 is furthermore provided, in the course of which is arranged a second heat exchanger 20. The third coolant path 19 can be connected to the bypass 17 via a controllable valve 21. Instead of the connection of the third coolant path 19 to the bypass 17, it is also possible to conceive of its being designed as a further bypass to the first coolant path 15. The preferably electrically controllable valve 21 operates either continuously or in cyclical operation.

A coolant pump 22 which is arranged in the coolant circuit and is driven by the engine 10 ensures the coolant transport. The pump 22 is referred to below as mechanical pump 22. A further coolant pump 23, the conveying capacity of which can be adjusted electrically, is connected in series to the mechanical pump 22. The additional coolant pump 23 is referred to below as electric pump 23.

An electronic switching device 24, to which are fed as input signals operating variables of the engine 10 and of the cooling circuit, is provided for controlling the electric pump 23. In particular, these variables are the engine speed detected by a speed sensor 25, the engine temperature detected by at least one engine temperature sensor 26, the coolant temperature detected by a coolant temperature sensor 27, the pressure of the coolant in the cooling circuit detected by a pressure sensor 28, the air temperature in the immediate vicinity of the engine 10 detected by an engine compartment temperature sensor 29, the temperature detected by at least one engine-part temperature sensor 30 and the temperature of the air in the wider environment (outside temperature) of the engine 10 detected by an ambient air temperature sensor 31.

Where the engine 10 is used as a driving motor in a motor vehicle, the travelling speed detected by a speed sensor 32, the signal emitted by a heating/ventilation controller 33 for specifying at least one desired temperature in the vehicle interior and the signal emitted by at least one heating-air temperature sensor 34 are fed to the electronic switching device 24 as additional input signals.

The electronic switching device 24 first of all sends an output signal to the electric pump 23. Further output signals are, if appropriate, sent to the valves 18, 21, provided that the two valves 18, 21 are electrically controllable. Output signals are furthermore sent to a actuator 35 which actuates an adjustable blind 36 arranged in front of the first heat exchanger 16 used as radiator, to at least one fan motor 37, 38 arranged at both of the heat exchangers 16, 20, and to a actuator 39 which actuates an air flap 41, is arranged in an air duct 40 leading away from the second heat exchanger 20 and opens the path of the air either to a heating air duct 42 or to an exhaust-air duct 43 leading to the open air.

The electronic switching device 24 furthermore sends an excess temperature warning signal or a signal which indicates a failure of a coolant pump 22, 23 to a device 44. The device 44 is, for example, a signal lamp on the dashboard of the motor vehicle or part of an engine control system. The engine power is restricted following the occurrence of a malfunction.

The device according to the invention and in accordance with FIG. 1 operates as follows:

Following the start-up of the engine 10, the mechanical pump 22 starts the conveyance of the coolant. The conveying capacity of the mechanical pump 22 depends on the speed of the engine 10 and is et to a value which is not sufficient for the required coolant conveying capacity. In the case of a cold engine 10, the coolant flows from the first cooling circuit connection 11, via the bypass 17 and the mechanical pump 22, back to the second cooling circuit connection 12. This small circuit results in virtually no cooling capacity, with the result that the engine 10 reaches the operating temperature at which it exhibits the maximum efficiency as rapidly as possible. In the case of a rise in the coolant temperature which is detected by the coolant temperature sensor 27, of which there is at least one, the controllable valve 18 opens, either partially or completely depending on the operating mode, the first coolant path 15 having the first heat exchanger 16 operated as radiator. In the case of a further coolant temperature increase, the previously closed blind 36 is opened with the air of the actuator 35, with the result that an increased cooling air flow is directed over the radiator 16. If required, the fan motor 37 is additionally switched on to further support the dissipation of heat from the radiator 16. A matching of the cooling capacity to the cooling capacity requirement is achieved with the electric pump 23 by altering the coolant flow. The matching to the cooling capacity requirement is effected not only as a function of the coolant temperature picked up by the coolant temperature sensor 27 but as a function of further signals. As input signals, for the electronic switching device 24 there serve the operating temperature of the engine 10, the air temperature in the immediate vicinity of the engine 10, the ambient temperature (outside temperature) measurable further away from the engine 10, the temperature of engine parts and the speed of the engine. In the case of a use of the device according to the invention in the motor vehicle, the electronic control device 24 also receives information on the travelling speed.

The information on, for example, the engine temperature or the temperature of certain engine parts makes it possible to increase the cooling capacity before a significant temperature increase of the coolant can be detected by the coolant temperature sensor 27. The inclusion of the speed for cooling-capacity control beings with it the advantage that the coolant flow can be increased using the electric pump 23 before the occurrence of a local heating up in the engine. The measurement of the travelling speed has a bearing, in particular, on the actuation of the blind 36 and of the fan 37. At higher travelling speeds, it would, for example, not be expedient to keep the blind 36 closed and to switch on the fan 37. Such inappropriate operating conditions can be recognized and avoided using the electronic switching device 24.

A further possibility of dissipating heat from the cooling circuit consists in the opening of the third coolant path 19. If the third coolant path 19 is connected to the bypass 17 via the controllable valve 21, the controllable valve 18 is either adjusted continuously or controlled in cyclical mode in such a way that at least part of the coolant flow flows back to the second cooling circuit connection 12 from the first cooling circuit connection 11 via the third coolant path 19 and second heat exchanger 20. The air heated at the second heat exchanger 20 is carried on by the duct 40 and by the ducts 42, 43. In the case of the use of the device according to the invention in the motor vehicle, the heating air duct 42 opens into the vehicle interior. The heating-air temperature sensor 34, in conjunction with the electronic switching device 24 and with further temperature sensors (not shown) in the heating system and in the motor vehicle interior, ensures the maintenance of a desired temperature in the interior. The waste air duct 43 leading to the open air permits the use of the second heat exchanger 20 as radiator even at high outside temperatures. In this operating case, the actuator 39 closes the heating-air duct 42 completely with the air flap 41.

If the cooling capacity provided by the second heat exchanger 20 is sufficient for engine cooling, the valve 18 can completely block the coolant flow through the first coolant path 15. This operating condition occurs in the case of motor vehicle heating in the winter. With the air of the electronic switching device 24 it can be determined that the coolant flow through the third coolant path 19 remains blocked during the warm-up phase of the engine 10 and is only opened if a minimum temperature exists. Admittedly, there is then no heating energy available during the starting phase. This mode can either be activated via the temperature controller 33 or is already preset in the electronic switching device 24. If required, the heat dissipation via the second heat exchanger 20 can be altered using the fan motor 38.

By correlation, the acquisition of the coolant pressure with the aid of the pressure sensor 28 in conjunction with the coolant temperature makes possible a diagnosis of the coolant condition (risk of vapour formation).

Figure 2:
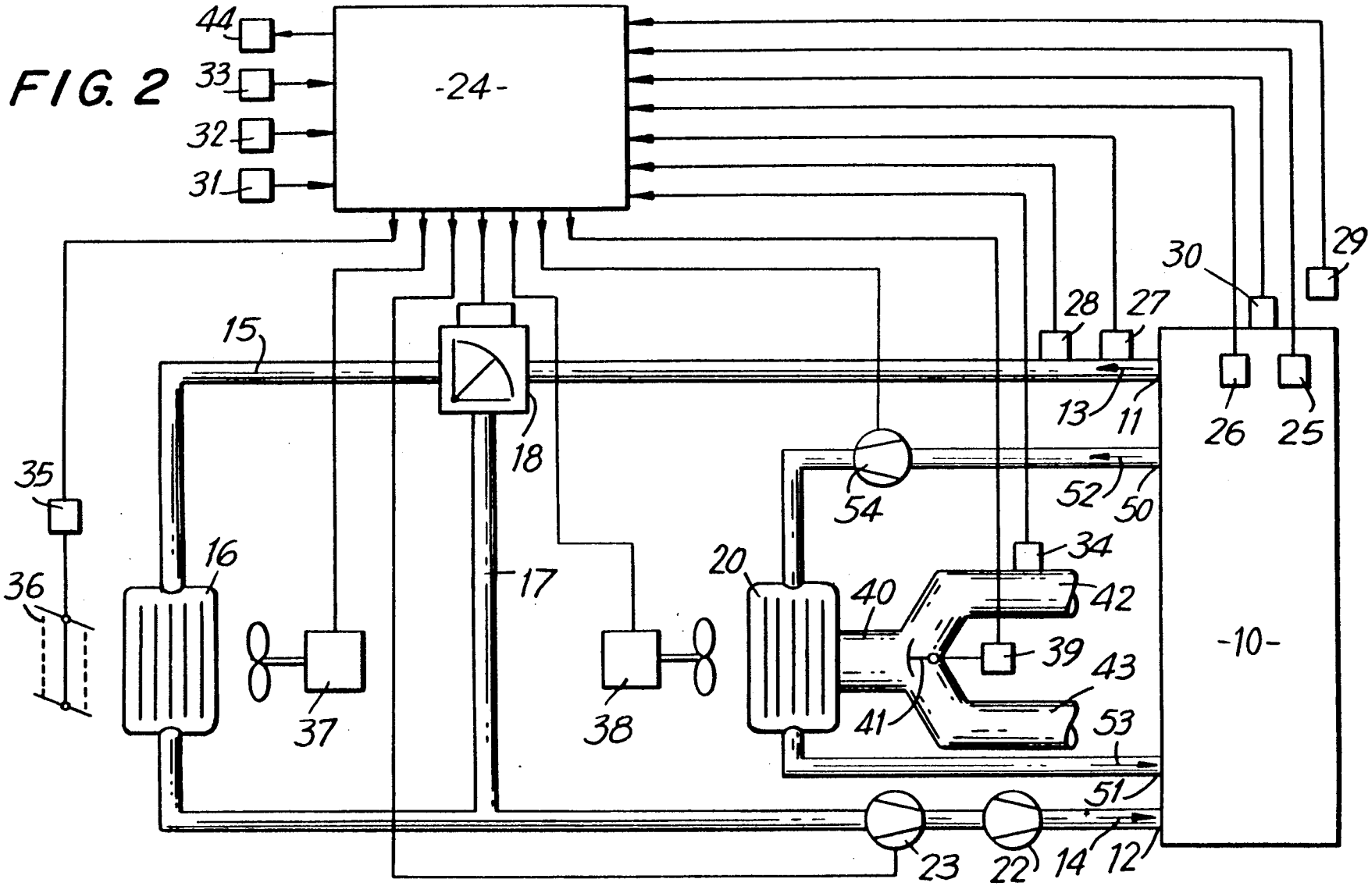

FIG. 2 shows a further advantageous exemplary embodiment of the device according to the invention. Those parts of FIG. 2 which correspond to those in FIG. 1 are provided with the same reference numerals. In the case of the device according to FIG. 2, the third coolant path 19 shown in FIG. 1 and the valve 21 arranged in the bypass 17 are no longer present. In contrast, the second heat exchanger 20 is arranged in a separate coolant circuit. The engine 10 therefore has a third coolant connection 50 and a fourth coolant connection 51. The coolant flows from the third coolant connection 50 to the fourth coolant connection 51. The direction of flow is indicated by arrows 52, 53. The coolant is circulated by a third coolant pump 54, the conveying capacity of which is preferably specifiable by an electric signal.

The division of the cooling circuit into two separate, mutually independent circuits brings with it the advantage that the engine can partially be cooled in different ways. The second cooling circuit with the second heat exchanger 20 serves to heat the vehicle or for heat dissipation of peak capacity levels, for which the first cooling circuit is not designed.

By means of the device according to the invention and the method for engine cooling according to the invention, a rapid attainment and precise maintenance of the coolant temperature is first of all achieved. As a result, the engine 10 is held in a temperature range characterized by maximum efficiency. The rapid heating-up process reduces wear at low operating temperatures. The adaptation of the cooling capacity to the required cooling capacity for the engine 10 contributes to a saving of energy, since the previous overdimensioning of the cooling circuit is dispensed with. The electronic switching device 24 excludes unreasonable operating conditions. In particular where the device according to the invention is used for cooling a motor vehicle engine, an optimum balance between necessary cooling and heating of the vehicle interior is possible.

Instead of the connection in series of the two pumps 22, 23, a connection in parallel can also be provided if nonreturn valves or devices having a similar action are arranged in the pump sections.

It will be understood that each of the elements described above, or two or more together, may also find a useful application in other types of constructions differing from the types described above.

While the invention has been illustrated an described as embodied in a method and device for engine cooling, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A device for cooling an engine having a coolant circuit which contains a heat exchanger, which is arranged in a first coolant path and can be operated as a radiator, said coolant circuit having a bypass leading around said heat exchanger to form a second coolant path, the distribution of the coolant flow to the heat exchanger and to the bypass being effected at least as a function of a coolant temperature, said coolant circuit having an electric coolant pump, the conveying capacity of which can be altered, wherein said coolant circuit having a third coolant path with an additional heat exchanger (20), said device also comprising at least one coolant temperature sensor, an electronic switching device (24) which controls the electric pump (23) as a function of the coolant temperature detectable by said coolant temperature sensor (27), said device also comprising a separate coolant circuit having a first and second coolant connection (50, 51) at the engine (10), which contains said additional heat exchanger (20) as well as an additional electric coolant pump (54) having a conveying capacity which can be altered by the electronic switching device (24), said device also comprising a mechanical coolant pump (22) located in said coolant circuit and having a conveying capacity, which is driven by the engine (10) to be cooled and the conveying capacity of which is set to a specifiable part of a required cooling capacity.

2. Device according to claim 1, further comprising at least one engine temperature sensor (26), an operating temperature of the engine (10) detected by said engine temperature sensor (26) being fed as an input signal to the electronic switching device (24).

3. Device according to claim 1, further comprising an engine compartment temperature sensor (29), a temperature detected by said engine compartment temperature sensor (29) in an immediate vicinity of the engine (10) being fed as an input signal to the electronic switching device (24).

4. Device according to claim 1, further comprising at least one engine part temperature sensor (30) for a temperature of at least one engine part to be cooled, said temperature being picked up by said engine part temperature sensor (30) being fed as an input signal to the electronic switching device (24).

5. Device according to claim 1, further comprising an ambient temperature sensor (31), an ambient temperature detected by said ambient temperature sensor (31) being fed to the electronic switching device (24).

6. Device according to claim 1, further comprising an engine speed sensor (25), a speed of the engine (10) detected by said engine speed sensor (25) being fed to the electronic switching device (24).

7. Device according to claim 1, further comprising a pressure sensor (28), a pressure of a coolant of the engine (10) detected by said pressure sensor (28) being fed to the electronic switching device (24).

8. Device according to claim 1, further comprising an electric fan (37,38) which is connected to and controlled by the electronic switching device (24) for air-cooling said heat exchanger (16,20) arranged in the coolant path (15; 17; 19; 52,53).

9. Device according to claim 1, wherein the engine (10) to be cooled is in a motor vehicle, and further comprising a travelling speed sensor (32), a travelling speed of the motor vehicle detected by said travelling speed sensor (32) being fed as a further input signal to the electronic switching device (24).

10. Device according to claim 9, further comprising a heating/ventilation controller (33) and wherein a signal emitted by said heating/ventilation controller (33) is fed to the electronic switching device (24).

11. Device according to claim 1, further comprising a blind (36), which can be actuated by the electronic switching device (24) via a actuator (35) for influencing the air flow through the heat exchanger (16).

12. A device according to claim 1 further comprising an air flap (41) positioned adjacent said additional heat exchanger (20), two air ducts (42,43) positioned in the vicinity of said air flap (41) and an actuator (39) connected to said air flap (41), the air heated by said additional heat exchanger (20) being distributed to the two air ducts (42,43) by means of the air flap (41) which can be actuated by the electronic switching device (24) via said actuator (39).

13. Device according to claim 1, wherein the electric coolant pump (23) and the mechanical coolant pump (22) are connected in series.

* * * * *